US006225902B1

(12) United States Patent
Gahan

(10) Patent No.: US 6,225,902 B1
(45) Date of Patent: May 1, 2001

(54) AUTOMATIC TELLER MACHINES

(75) Inventor: Ian Gahan, Newtyle (GB)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/324,326

(22) Filed: Jun. 2, 1999

(30) Foreign Application Priority Data

Jun. 16, 1998 (GB) ..... 9812842

(51) Int. Cl.[7] ..... G08B 21/00

(52) U.S. Cl. ..... 340/540; 340/541; 340/825.35; 367/7; 235/379; 194/200

(58) Field of Search ..... 340/825.35, 825.24, 340/825.33, 825.32, 566, 540, 541; 367/197, 198, 199; 235/379, 380, 381, 382; 194/200, 202, 205

(56) References Cited

U.S. PATENT DOCUMENTS 3,946,204 * 3/1976 Taniguchi et al. ..... 235/61.11
5,519,669 * 5/1996 Ross et al. ..... 367/93
5,598,793 * 2/1997 Lopez, Jr. ..... 109/25
5,945,602 * 8/1999 Ross ..... 340/566
6,068,184 * 5/2000 Barnett ..... 235/379
6,092,723 * 7/1998 Harvey ..... 235/679

FOREIGN PATENT DOCUMENTS 1420043 7/1973 (GB) .
2020871 11/1979 (GB) .
2034950 6/1980 (GB) .
2119993 11/1983 (GB) .

* cited by examiner

*Primary Examiner*—Jeffery Hofsass
*Assistant Examiner*—Daniel Previl
(74) *Attorney, Agent, or Firm*—Francis L. Conte

(57) ABSTRACT

An ATM is provided with a loudspeaker and a microphone. The loudspeaker generates white noise which is picked up by the microphone. The detected signal constitutes an acoustic signature which changes if the ATM is tampered with, for example by inserting some fraudulent mechanism into the ATM to intercept banknotes before they reach the output slot of the ATM. If any such change is detected then an alarm can be raised.

30 Claims, 2 Drawing Sheets

AUTOMATIC TELLER MACHINES

BACKGROUND OF THE INVENTION

This invention relates to Automatic Teller Machines (ATMs). It is particularly concerned with the detection of fraud in such machines.

One function of an ATM is to dispense banknotes to a user. A standard ATM having the facility to dispense banknotes includes electronic control means in the form of a central processing unit (CPU) which is connected to a cash dispenser unit and a user interface device. The user interface device comprises a display unit, a keypad, a card reader and an output slot through which the cash dispenser unit dispenses banknotes to a user. As is well known, to operate such an ATM a user inserts a user's identity card into the card reader and then enters certain data, such as a personal identification number (PIN) and the quantity of currency required to be dispensed, by mean of the keypad. The ATM will then process the requested transaction, dispense banknotes extracted from one or more storage cassettes within the currency dispenser unit, update the user's account to reflect the transaction and return the card to the user.

One advantage of ATMs is that they operate without human supervision and can be located at sites away from bank premises. A drawback is that they are vulnerable to being tampered with for the perpetration of fraud or other types of theft. One of the more common methods of attack is to add or insert mechanisms into the ATM to prevent their standard operation and either capture the contents of a transaction or record confidential information.

SUMMARY OF THE INVENTION

It is an object of the invention to detect the presence or absence of fraudulent equipment in an ATM.

According to the invention an automatic teller machine includes a loudspeaker and a microphone, signal generator means connected to the loudspeaker for enabling the loudspeaker to generate an acoustic signal and means for evaluating the signal received by the microphone to determine whether the signal has been modified by the presence of any foreign object in the machine.

Preferably the acoustic signal that is generated is white noise.

In carrying out the invention means may be provided for comparing the received signal with a previously recorded standard received signal. Any significant difference between the compared signals indicates the presence of a foreign object.

The generator means may be operated at the start of a teller operation and again on its completion. Provided that the two received signals are not significantly different the latter signal is then used thereafter as the standard received signal. This allows for the small incremental changes in the received signal that take place over time due to wear in the parts of the ATM without such wear being mistaken for tampering.

BRIEF DESCRIPTION OF THE DRAWINGS

In order that the invention may be more fully understood reference will now be made to the accompanying drawings in which.

DETAILED DESCRIPTION

Figure 1:
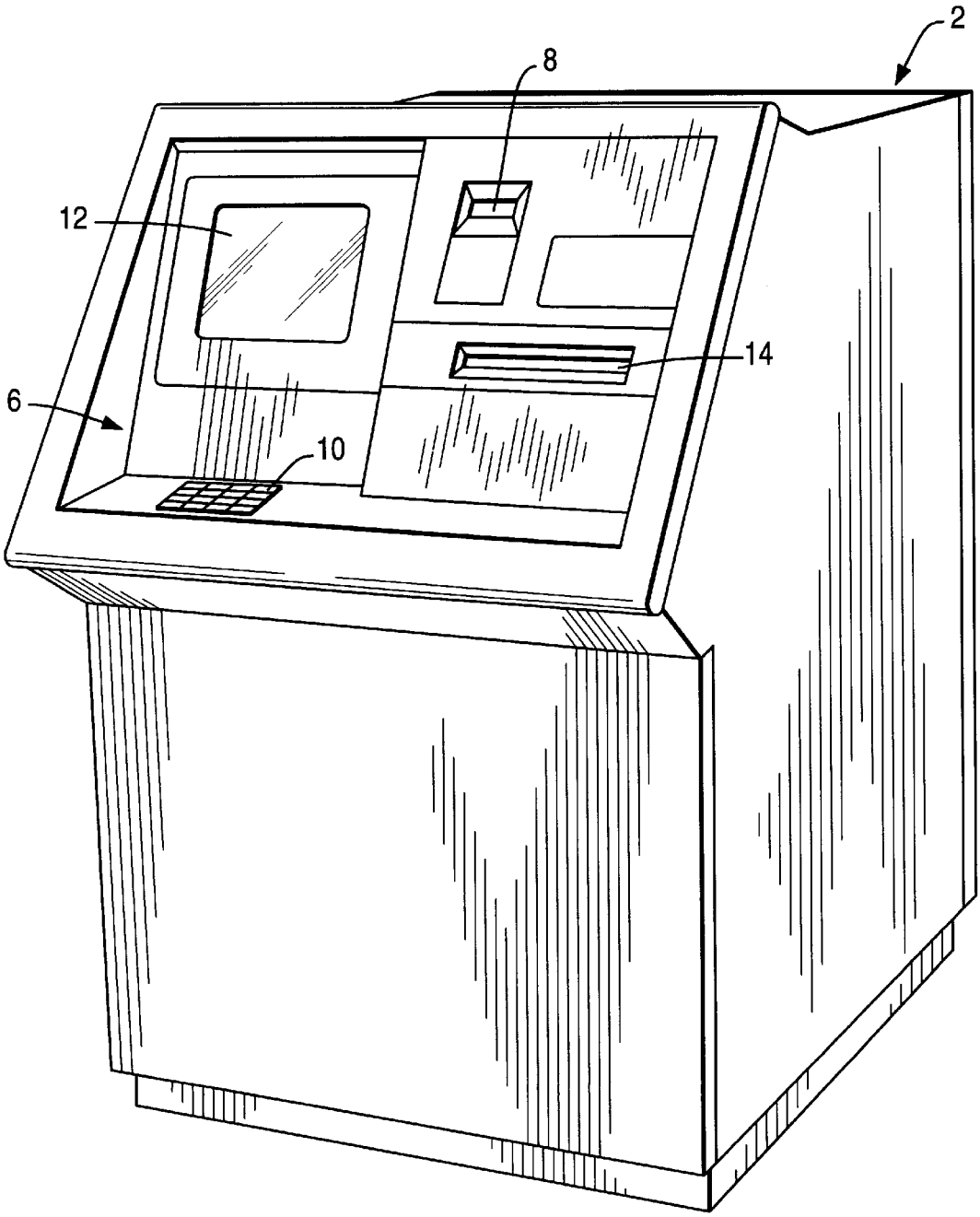
FIG. 1 is an external perspective view of an ATM.

As shown in FIG. 1 an ATM 2 includes a user interface 6 incorporating a slot 8 for receiving a user identity card. Slot 8 is part of a card reader contained within ATM 2. User interface 6 also includes a keypad 10 through which data can be inputted, a screen 12 for displaying information and an output slot 14 for dispensing banknotes to a user. ATM 2 incorporates a CPU to receive data from the card reader and keyboard 10 and control a cash dispenser unit which extracts banknotes from one or more storage cassettes and dispenses the extracted banknotes to output slot 14. The CPU, cash dispenser unit and banknote storage cassettes are all located within ATM 2 and are not visible in the external view of ATM 2 shown in FIG. 1. These items of equipment are well-known and are therefore not described herein in detail.

Figure 2:
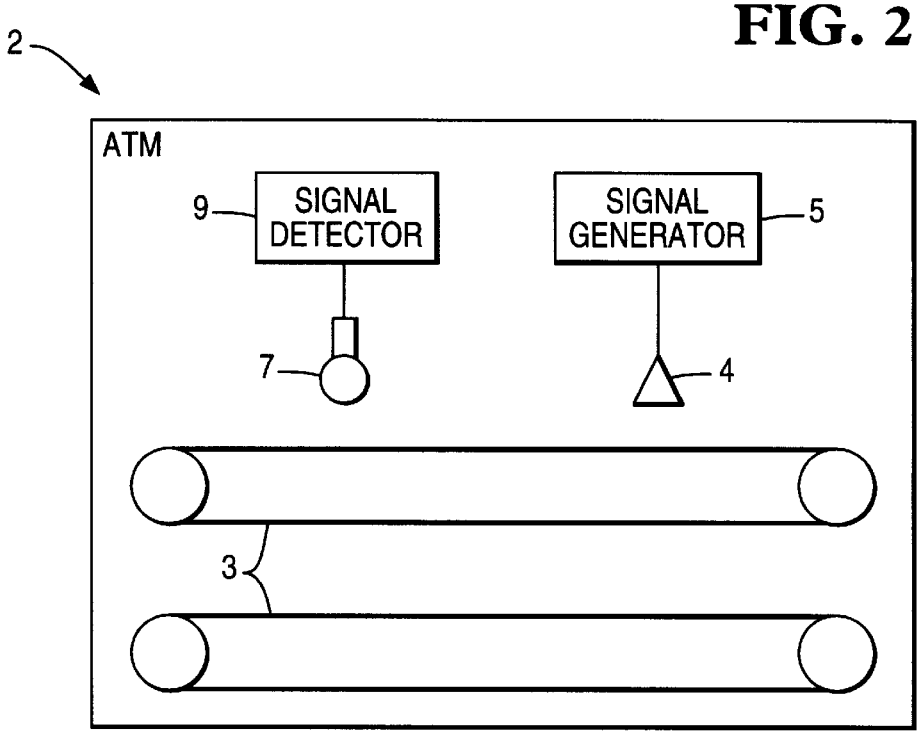
FIG. 2 is an internal diagrammatic view of an ATM embodying the invention.

Referring now to FIG. 2 there is shown therein part of the internal mechanism of ATM 2 in diagrammatic form. In particular the cash dispenser unit of ATM 2 includes a transport mechanism 3 by which banknotes are transferred from storage cassettes to output slot 14 of FIG. 1. Included within ATM 2 is a loudspeaker 4 which is energized from a signal generator 5. A microphone 7 is positioned within ATM 2 to receive signals from loudspeaker 4 and the output from microphone 7 is taken to a signal detector 9 which incorporates a processor. Signal generator 5 is designed to generate white noise. The nature of the sound detected in microphone 7 when signal generator 5 is functioning depends on the nature and positioning of the various pieces of equipment contained within ATM 2. The detected sound constitutes a sound signature distinctive of the particular ATM and this signature will be different if the equipment within ATM 2 is added to or is moved.

Figure 3:
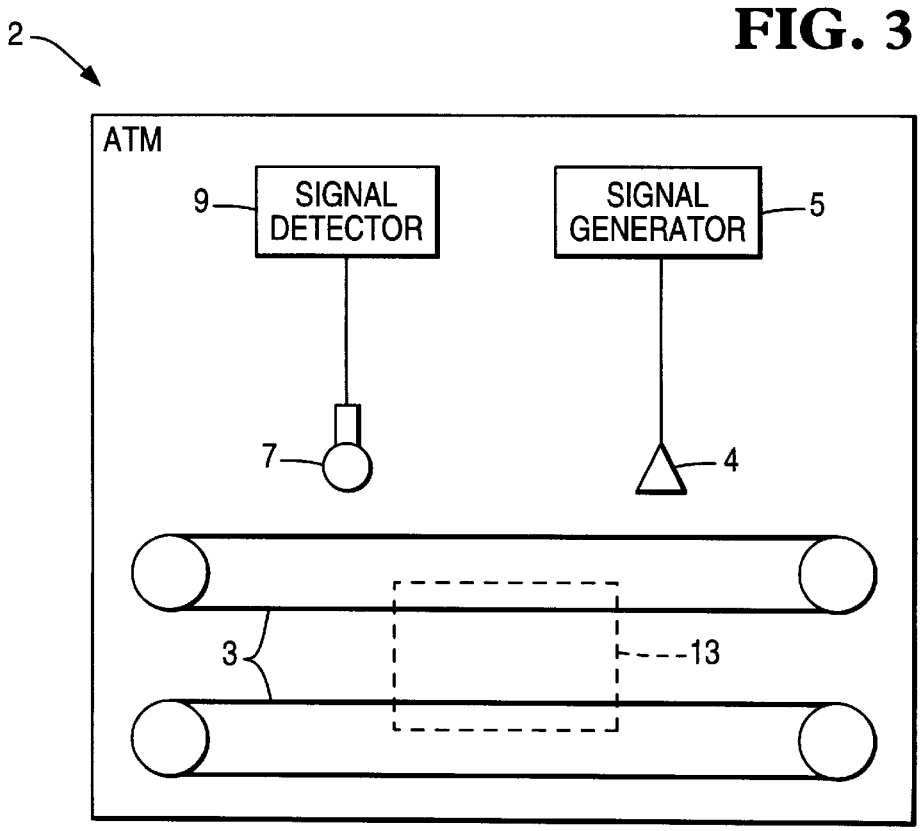
FIG. 3 shows the ATM of FIG. 2 after a fraudulent device has been added.

An illustration of an ATM that has been tampered with is shown in FIG. 3, in which like parts have the same reference numerals as in FIG. 2. ATM 2 in FIG. 3 includes a mechanism 13 that has been fraudulently added. Mechanism 13 is positioned relative to banknote transport mechanism 3 to trap banknotes in their passage from storage cassettes to output slot 14.

To detect the presence or absence of mechanism 13 an initial signal is first detected and recorded by sampling the white noise generated by loudspeaker 4 when it is known that ATM 2 is in an untampered state. This signal then constitutes a standard signal. After each operation of ATM 2 signal generator 5 is energized again and the detected signal compared with the standard signal. If there is a significant difference between the two signals then this is an indication that ATM 2 has been tampered with and an alarm signal can then be generated.

In practice a standard signal can be generated on a regular basis, conveniently before each operation of ATM 2. If the new standard signal is not significantly different from the previous standard signal then the new signal is used as the standard. This updating of the standard signal ensures that wear within ATM 2 is automatically catered for without such wear being mistaken for tampering.

What is claimed is:

1. An automatic teller machine (ATM) comprising:

means including a loudspeaker for generating an acoustic signal; and means for determining whether the acoustic signal has been modified by the presence of any foreign object in the ATM.

2. An ATM according to claim 1, wherein the acoustic signal that is generated is white note.

3. An ATM according to claim 1, further comprising means for recording a standard signal against which subsequent signals are compared for determining whether the acoustic signal has been modified by the presence of said foreign object in the ATM.

4. An ATM according to claim 3, wherein said recording means are configured to update the standard signal to allow for wear of said ATM.

5. An ATM according to claim 4, further comprising means for comparing each of said subsequent signals as a received signal with the standard signal.

6. An automatic teller machine (ATM) comprising:

means including a loudspeaker for generating an acoustic signal; and means for determining whether the acoustic signal has been modified by the absence of equipment in the ATM.

7. An ATM according to claim 6, wherein the acoustic signal that is generated is white noise.

8. An ATM according to claim 6, further comprising means for recording a standard signal against which subsequent signals are compared for determining whether the acoustic signal has been modified by the absence of said equipment in the ATM.

9. An ATM according to claim 8, wherein said recording means are configured to update the standard signal to allow for wear of said ATM.

10. An ATM according to claim 9, further comprising means for comparing each of said subsequent signals as a received signal with the standard signal.

11. An automatic teller machine (ATM) comprising:

a loudspeaker;

a microphone;

a signal generator connected to the loudspeaker and for enabling the loudspeaker to generate an acoustic signal; and a signal detector for evaluating the signal received by the microphone to determine whether the acoustic signal has been modified by the presence of any foreign object in the ATM.

12. An ATM according to claim 11, wherein the acoustic signal that is generated is white noise.

13. An ATM according to claim 11, further comprising a recorder for recording said signal detected by said microphone as a standard signal against which subsequent received signals are compared in said signal detector for evaluating the signal received by the microphone to determine whether the acoustic signal has been modified by the presence of said foreign object in the ATM.

14. An ATM according to claim 13, wherein said recorder is configured to update the standard signal to allow for wear of said ATM.

15. An ATM according to claim 14, further comprising a comparator for comparing each of said subsequent signals as said received signal with the standard signal.

16. An automatic teller machine (ATM) comprising:

a loudspeaker;

a microphone;

a signal generator connected to the loudspeaker and for enabling the loudspeaker to generate an acoustic signal; and a signal detector for evaluating the signal received by the microphone to determine whether the acoustic signal has been modified by the absence of equipment in the ATM.

17. An ATM according to claim 16, wherein the acoustic signal that is generated is white noise.

18. An ATM according to claim 16, further comprising a recorder for recording said signal detected by said microphone as a standard signal against which subsequent received signals are compared in said signal detector for evaluating the signal received by the microphone to determine whether the acoustic signal has been modified by the absence of equipment in the ATM.

19. An ATM according to claim 18, wherein said recorder is configured to update the standard signal to allow for wear of said ATM.

20. An ATM according to claim 19, further comprising a comparator for comparing each of said subsequent signals as said received signal with the standard signal.

21. A method of operating an automatic teller machine (ATM), the method comprising the steps of:

generating an acoustic signal in a loudspeaker; and determining whether the acoustic signal has been modified by the presence of any foreign object in the ATM.

22. A method according to claim 21, wherein the acoustic signal that is generated is white noise.

23. A method according to claim 21, further comprising the step of recording a standard signal against which subsequent signals are compared for determining whether the acoustic signal has been modified by the presence of said foreign object in the ATM.

24. A method according to claim 23, further comprising updating the standard signal to allow for wear of said ATM.

25. A method according to claim 24, further comprising the step of comparing each of said subsequent signals as said received signal with the standard signal.

26. A method of operating an automatic teller machine (ATM), the method comprising the steps of:

generating an acoustic signal in a loudspeaker; and determining whether the acoustic signal has been modified by the absence of equipment in the ATM.

27. A method according to claim 26, wherein the acoustic signal that is generated is white noise.

28. A method according to claim 26, further comprising the step of recording a standard signal against which subsequent signals are compared for determining whether the acoustic signal has been modified by the absence of equipment in the ATM.

29. A method according to claim 28, further comprising updating the standard signal to allow for wear of said ATM.

30. A method according to claim 29, further comprising the step of comparing each of said subsequent signals as said received signal with the standard signal.

* * * * *